US010088222B2

(12) United States Patent
Caglin et al.

(10) Patent No.: US 10,088,222 B2
(45) Date of Patent: Oct. 2, 2018

(54) HOME APPLIANCE DEVICE

(71) Applicant: BSH-HAUSGERAETE GMBH, Munich (DE)

(72) Inventors: Muharrem Uemit Caglin, Istanbul (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/363,021

(22) Filed: Nov. 29, 2016

(65) Prior Publication Data

US 2018/0149418 A1 May 31, 2018

(51) Int. Cl.
*F25D 25/02* (2006.01)
*F25D 27/00* (2006.01)

(52) U.S. Cl.
CPC ..... *F25D 25/02* (2013.01); *F25D 27/00* (2013.01); *F25D 2325/022* (2013.01)

(58) Field of Classification Search
CPC .. F25D 27/00; A47F 3/001; A47F 3/04; A47F 11/10; F21V 21/08; F21V 33/0044; F21W 2131/305; F21W 2131/405
USPC ..... 220/4.02, 3.2, 3.3, 3.5, 3.6, 3.92, 3.94; 362/92, 94, 133; 312/223.5, 223.6, 400, 312/401; 174/152 G, 153 G
See application file for complete search history.

(56) References Cited

U.S. PATENT DOCUMENTS 5,953,931 A * 9/1999 Brittain ..... F25D 21/14 220/371
6,901,627 B2 * 6/2005 Uchida ..... B60R 16/0222 16/2.1
7,222,394 B2 * 5/2007 Gardner ..... F16L 5/10 16/2.1
8,047,683 B2 * 11/2011 Olesen ..... A47L 15/4246 134/56 D
2007/0223226 A1 * 9/2007 Park ..... H01L 25/0753 362/267
2007/0228910 A1 10/2007 Ertz
2010/0220460 A1 * 9/2010 Hall ..... F25D 27/00 362/92
2013/0176728 A1 * 7/2013 Bizzotto ..... F21V 21/08 362/244
2013/0207527 A1 * 8/2013 Heinrich ..... F25D 23/067 312/223.1

(Continued)

FOREIGN PATENT DOCUMENTS

CN 203421890 U 2/2014
DE 102010039574 * 2/2012

(Continued)

*Primary Examiner* — Janet Marie Wilkens
(74) *Attorney, Agent, or Firm* — Laurence A. Greenberg; Werner H. Stemer; Ralph E. Locher

(57) ABSTRACT

For the purpose of improving flexibility a home appliance device, in particular a home appliance chiller device, is proposed. The device includes an insert which is insertable into a storage space, a base element, a receptacle fixable to the base element and a fixing unit for fixing the receptacle and the base element to each other, having a first fixing element and a second fixing element which are arranged offset in a vertical direction and in a horizontal direction with respect to each other and which together at least partly encompass the base element and/or the receptacle in a mounted state.

17 Claims, 3 Drawing Sheets

(56) References Cited

U.S. PATENT DOCUMENTS

| | | | | |
|---|---|---|---|---|
| 2013/0208446 | A1* | 8/2013 | Heinrich | F25D 27/00 362/92 |
| 2014/0055017 | A1 | 2/2014 | McMillin et al. | |
| 2016/0018099 | A1* | 1/2016 | Erdem | F25D 27/00 362/92 |
| 2016/0174733 | A1* | 6/2016 | Cinici | A47F 3/001 312/128 |
| 2016/0178275 | A1* | 6/2016 | Cetinyol | F25D 27/00 62/264 |
| 2017/0023232 | A1* | 1/2017 | Signorino | F21V 7/00 |
| 2017/0102180 | A1* | 4/2017 | Dinter | F25D 27/00 |

FOREIGN PATENT DOCUMENTS

| | | | |
|---|---|---|---|
| DE | 202014100627 | * | 5/2014 |
| FR | 2302248 | * | 9/1976 |
| KR | 20110045445 A | | 5/2011 |

* cited by examiner

HOME APPLIANCE DEVICE

BACKGROUND OF THE INVENTION

Field of the Invention

The invention relates to a home appliance device, in particular a home chiller appliance device.

From the prior art a home appliance is known which comprises an insert insertable into a storage space and a receptacle fixed to the insert.

SUMMARY OF THE INVENTION

An objective of the invention is, in particular, to provide a home appliance device with improved characteristics regarding flexibility. This objective is achieved, according to the claimed invention. Further implementations and further developments of the invention may be gathered from the dependent claims.

A home appliance device, in particular a home chiller appliance device, is proposed, comprising: an insert which is insertable into a storage space, the insert comprising a base element, a receptacle fixable to the base element, and a fixing unit for fixing the receptacle to the base element, the fixing unit having at least one first fixing element and at least one second fixing element which are arranged offset in a vertical direction and in a horizontal direction with respect to each other and which together at least partly encompass the base element and/or the receptacle in a mounted state of the receptacle.

By means of the invention, in particular a flexibility of the home appliance device can be improved. In particular the same home appliance device can be applied to different architectures and topologies of home appliances. Advantageously the receptacle can be repeatably fixed to or unfixed from the base element, in particular without the need of any tools. Advantageously replacement of different components of the home appliance device can be simplified.

In this context, "configured" is in particular to mean specifically programmed, designed and/or equipped. By an object being configured for a certain function is in particular to be understood that the object implements and/or fulfills said certain function in at least one application state and/or operating state.

By a "home appliance device" is in particular to be understood at least a portion, preferably a sub-assembly group, of a home appliance. The home appliance is in particular provided for storing and preferably tempering victuals such as beverages, in particular alcoholic beverages such as wine, meat, fish, vegetables, fruits, milk and/or dairy products in at least one operating state, advantageously for the purpose of enhancing a quality and/or a shelf life of the stored victuals. For example, the home appliance is embodied as a home chiller appliance, which is in at least one operating state configured for cooling victuals. The home chiller appliance could in particular be embodied as a climate cabinet, an icebox, a wine-cooler, a freezer and/or a refrigerator-freezer combination. For example, the home chiller appliance is embodied as a refrigerator. However, the home appliance could also be embodied as a home appliance for warming up and in particular for cooking victuals, e.g. an oven, a steamer and/or a microwave.

The storage space may in particular be a spatial region of the home appliance device which is provided for storing victuals and which is in particular delimited by an inner liner of the home appliance device. The storage space may in particular be at least partly divisible into at least two storage areas, in particular a plurality of storage areas. The insert may in particular be configured for storage of victuals, e.g. by providing a top surface on which victuals may be placed.

The insert may in particular be implemented as a shelf, preferably an at least partly transparent shelf, e.g. made of glass and/or of a transparent plastic, as a cover for a drawer, which may in particular be configured for adjusting humidity in the drawer, a bottle holder and/or a dividing plate. For example, the insert may be implemented as a dividing plate which, in particular in an installation position of the insert, may divide the storage space into at least two storage areas.

The insert, in particular the base element, may comprise in particular a main extension plane, which may at least substantially be parallel to a horizontal plane of the home appliance device. In this context, a "horizontal plane of the home appliance device" is in particular to be understood as a main extension plane of a base onto which the home appliance device is installed in an installation position. A "main extension plane" of an object is, in particular, to be understood as a plane extending parallel to a largest side of an imaginary rectangular cuboid which only just entirely encloses the object and preferably extends through a geometric center of the object. In this context "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°. Further, the main extension plane of the insert and/or the base element is at least substantially perpendicular to a main extension direction of the home appliance device. A "main extension" of an object is, in particular, to be understood as a largest extension of an imaginary rectangular cuboid which only just entirely encloses the object and which preferably extends through a geometric center of the object. In particular in an installation position of the insert, the base element may face towards the base onto which the home appliance device is installed.

The insert may comprise in particular a lighting unit. The lighting unit may in particular be configured for lighting at least partly the storage space, in particular a storage area below the insert. In particular in an installed state of the insert, the lighting unit may shine at least in a direction of the base onto which the home appliance device is installed. The lighting unit may comprise in particular at least one or at least two or multiple light source/s. The light source is may in particular be an LED or preferably an OLED. The lighting unit may in particular be at least partly or at least mostly or entirely accommodated inside the receptacle. The term "at least mostly" with reference to an object is in particular to mean by more than 50%, preferably by more than 70%, and advantageously by more than 90%. In particular for accommodating the lighting unit, the receptacle may comprise an accommodating housing inside which the lighting unit is at least partly or at least mostly or entirely accommodated. The receptacle may comprise in particular a terminal unit for connecting the lighting unit, by means of which the lighting unit is connected to an energy unit of the home appliance device which supplies power for operating the lighting unit. Furthermore, the lighting unit may be connected to a control unit of the home appliance device, which may be configured to control a state of the lighting unit, in particular a state of the light source.

In particular, the fixing unit may fix the receptacle removably, in particular toollessly removably, to the base element.

The fixing unit may in particular comprise at least one third fixing element, wherein in particular the first fixing element and the third fixing element are arranged offset in a vertical direction and in a horizontal direction with respect to each other and in particular the second fixing element and the third fixing element are arranged offset only in a horizontal direction with respect to each other. In particular, the second fixing element and the third fixing element may be implemented at least substantially equivalently to one another. In this context, "at least substantially equivalently" is to mean equivalently except for production and/or manufacturing tolerances. In particular, the description regarding the second fixing element is also applicable to the third fixing element.

In addition the fixing unit may comprise at least one further first fixing element, at least one further second fixing element and/or at least one further third fixing element, which are at least substantially implemented equivalently to the respective first fixing element, to the respective second fixing element and/or to the respective third fixing element except for their position/positions, which is/are in particular opposite and preferably mirror-inverted to the respective position of the first fixing element, the second fixing element and/or the third fixing element. In particular the description regarding the first fixing element, the second fixing element and/or the third fixing element is also applicable to the further first fixing element, the further second fixing element and/or the further third fixing element.

The vertical direction may in particular be at least substantially perpendicular to the horizontal plane. The horizontal direction is at least substantially parallel to the horizontal plane. In this context "at least substantially perpendicular" is in particular to be understood as an orientation of a direction with respect to a reference direction, in particular in a plane, wherein the direction and the reference direction include an angle of 90°, the orientation in particular having a deviation of less than 15°, advantageously of less than 10° and particularly advantageously of less than 2°. In particular, the offset in the vertical direction is in particular at least substantially equivalent to an extension, for example a thickness, of the base element, which may in particular be at least substantially perpendicular to a main extension of the base element. In particular, the offset in the horizontal direction is substantially equal to at least 10%, preferably at least 20% and advantageously at least 40% of a main extension of the receptacle. A "main extension" of an object is, in particular, to be understood, in this context, as a longest side of an imaginary rectangular cuboid which only just entirely encloses the object.

Further, it is proposed that the fixing unit may fix the receptacle to the base element at least in a form-fit manner. It is also conceivable that the fixing unit may fix the receptacle and the base element to each other in a force-fit manner. In particular the base element may be clamped between the first fixing element and the second fixing element. By the term "fixing in a force-fit and/or form-fit manner" is in particular to be understood, for example releasably fixed, that a holding force between two structural components may be transferred via a geometric engagement of the structural components with each other, and/or via a friction force acting between the structural components. Alternatively or additionally a fixation of the receptacle and the base element to each other may be provided by substance-to-substance bond, for example an adhesive and/or cohesive connection, e.g. by a welding process, an adhesive bonding, an injection-molding process and/or by another process that is deemed expedient by a person having ordinary skill in the art. As a result, in particular the receptacle and the base element may be fixed to each other without using tools. For example a fixation of the receptacle and the base element can be further simplified.

It is also proposed that the first fixing element may be embodied as a deformable fixing element. For example, the first fixing element may at least partly be deformable in a direction that is at least substantially perpendicular to the main extension direction of the receptacle. In this context, "deformable" may in particular be intended to mean elastically deformable, for example reversibly deformable and in particular repeatedly reversibly deformable. The first fixing element may in particular be at least partly or at least mostly or entirely made of a deformable material which may comprise an elastic modulus of at most 10 GPa or at most 5 GPa or at most 1 GPa or at most 0.1 GPA. The first fixing element may in particular be at least partly or at least mostly or entirely made of a thermoplastic material, a duroplastic material and/or an elastomer. For example the first fixing element may in particular be at least partly made of plastic, rubber and/or silicone. In particular, the first fixing element may comprise a greater deformability than the second fixing element. In this context, by an object having "a greater deformability" than another object is in particular to be understood that the objects differ in regard to their deformability, preferably due to design (e.g. wall thickness) and/or material characteristics, such as an elastic modulus. In particular, the elastic modulus of the first fixing element is in particular by at least 10%, preferably by at least 50%, further preferably by at least 100% and advantageously at least 200% smaller than the elastic modulus of the first fixing element. As a result of this, in particular a fixation of the receptacle can be simplified. Advantageously the receptacle can be fixated in a tool-free fashion.

In a further implementation of the invention it is proposed that the first fixing element may comprise a hook. The hook may in particular be embodied as a deformable latching hook. The first fixing element may comprise a deformable latching arm, which may be connected to the hook. The hook may comprise in particular a limiting surface which is in contact with the base element in an installed position and via which the base element is clamped from at least one first side. As a result of this, an assembly can be simplified.

For the purpose of improving stability, it may be proposed that the second fixing element may comprise a stopper. In particular, the second fixing element may comprise a further limiting surface which may be in contact with the base element in an installed position and via which the base element is clamped from a second side, which may in particular be opposite to the first side. In a further implementation of the invention it is proposed that the first fixing element may, in a mounted state of the receptacle, be arranged on the first side of the base element and the second fixing element may, in a mounted state of the receptacle, be arranged on the second side of the base element.

The fixing unit may in particular be at least partly implemented integrally with the base element and/or the receptacle. "Implemented integrally" is in particular to mean, in this context, connected at least by substance-to-substance bond, e.g. by a welding process, an adhesive bonding, an injection-molding process and/or by another process that is deemed expedient by a person having ordinary skill in the art. For example, "implemented integrally" could in particular mean made of one piece. "Made of one piece" is, in particular, to mean, in this context, manufactured from one single piece, e.g. by production from one single cast and/or by manufacturing in a one-component or multi-component injection-molding process, and advantageously from a single blank. Alternatively the fixing unit may be implemented separately from the base element and or from the receptacle. In this context, "implemented separately" is in particular to mean embodied separate from any other unit of the home appliance device and in particular not implemented integrally with any other unit of the home appliance device. In a further implementation of the invention it is proposed that the fixing unit may at least partly be implemented integrally with the receptacle. As a result of this, in particular a number of components can be reduced. Advantageously additional cost for additional components can be avoided. Preferably a construction of the fixing unit can be kept simple.

In a further implementation of the invention it is proposed that the receptacle may comprise a first wall section which at least partly embodies the first fixing element. In particular the first wall section extends around the receptacle in a circumferential direction. The first wall section extends over at most 20% or at most 16% or at most 12% of a circumference of the receptacle. In a further implementation of the invention it is proposed that the receptacle may comprise a second wall section adjacent to the first wall section, which may at least partly embody the second fixing element. In particular, the second wall section may extend around the receptacle in a circumferential direction. The second wall section extends over at least 30% or at least 34% or at least 38% of a circumference of the receptacle.

In particular for the purpose of improving deformability, it is proposed that the first wall section and the second wall section may be embodied at least partly separate from one another. In particular the first wall section and the second wall section may be separated by a notch in the receptacle. In particular a main extension direction of the notch may at least be substantially perpendicular to a main extension direction of the receptacle.

It is also proposed that the insert may comprise a poka-yoke unit which defines an orientation of the receptacle with respect to the base element. The poka-yoke unit may comprise in particular a first poka-yoke element and a corresponding second poka-yoke element, which cooperate with each other when the receptacle is fixed to the base element in the defined orientation. In a further implementation of the invention it is proposed that the poka-yoke unit may at least partly be implemented integrally with the receptacle and/or the base element. In particular, the first poka-yoke element may be implemented integrally with the receptacle, in particular the second wall section of the receptacle. The first poka-yoke element may be embodied as a console or protrusion of the receptacle, in particular the first wall section. In particular, the second poka-yoke element may be implemented integrally with the base element. The second poka-yoke element may in particular be embodied as a recess of the base element. Alternatively or additionally, there may be a console or protrusion in the base element and a recess in the receptacle. As a result of this, an assembly and/or disassembly can be further simplified.

The insert may comprise a cover element which may at least partly or at least largely or essentially entirely cover the base element. The cover plate may be plate-shaped. The cover plate may be the lowermost plate-shaped element of the insert. The cover element may in particular be located below the base element. An outer surface of the cover element may delimit a storage space. The cover element may delimit at least partly an air channel within the insert. This air channel may be configured for ventilating a storage space below the insert. The cover plate may also comprise air inlet vents and/or air outlet vents for fluidly connecting the air channel with the storage space. These vents may be located on an outer horizontal surface of the cover element. The insert may comprise a gap between the cover element and the base element. This gap may at least partly implement the air channel and/or may at least partly be filled with insulation material. The cover element may comprise a receptacle recess, which in particular corresponds to a shape of the receptacle and may be configured for at least partly or at least mostly or entirely accommodating the receptacle in the cover element. An outer surface of the cover element, in particular a surface facing away from the base element, may be arranged at least partly at least substantially flush with the receptacle. In this context, "at least substantially flush" is in particular to mean flush except for production and assembly tolerances. The cover element may be made at least partly or entirely of plastic, for example be an injection molded part. The cover plate may be fixed to the insert removably, in particular toollessly removably. In a service situation, e.g. a lightning unit accommodated inside the receptacle needs to be exchanged, the cover plate can be disconnected from the insert and subsequently the receptacle can be disconnected from the insert.

The insert may comprise a plate element which may at least partly or at least largely or essentially entirely cover the base element. The plate element may be plate-shaped. The plate element may be the uppermost plate-shaped element of the insert. The plate element may in particular be located above the base element. An outer surface of the plate element may delimit a storage space. An outer surface of the plate element may be usable for placing goods to be stored in the storage space on this surface and/or for placing a drawer of the home appliance device onto that outer surface. The plate element may be made of glass or plastic or metal.

The receptacle may be implemented integrally. For example the receptacle may be made of plastic, in particular be an injection molded part.

The receptacle may be fixed only to the base plate. In particular, in case the insert comprises a plate element, an air channel, insulation and/or a cover plate, the receptacle may not be fixed to these elements. In particular, in case the insert comprises a cover element which comprises a receptacle recess, the receptacle is not fixed to the receptacle recess. There may be a clearance between the receptacle recess and the receptacle. This allows to securely fix the receptacle, namely to the base plate only, while for example manufacturing or assembly tolerances of other elements of the insert will not have an effect.

Herein the home appliance device is not to be limited to the application and implementation described above. In particular, for the purpose of fulfilling a functionality herein described, the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
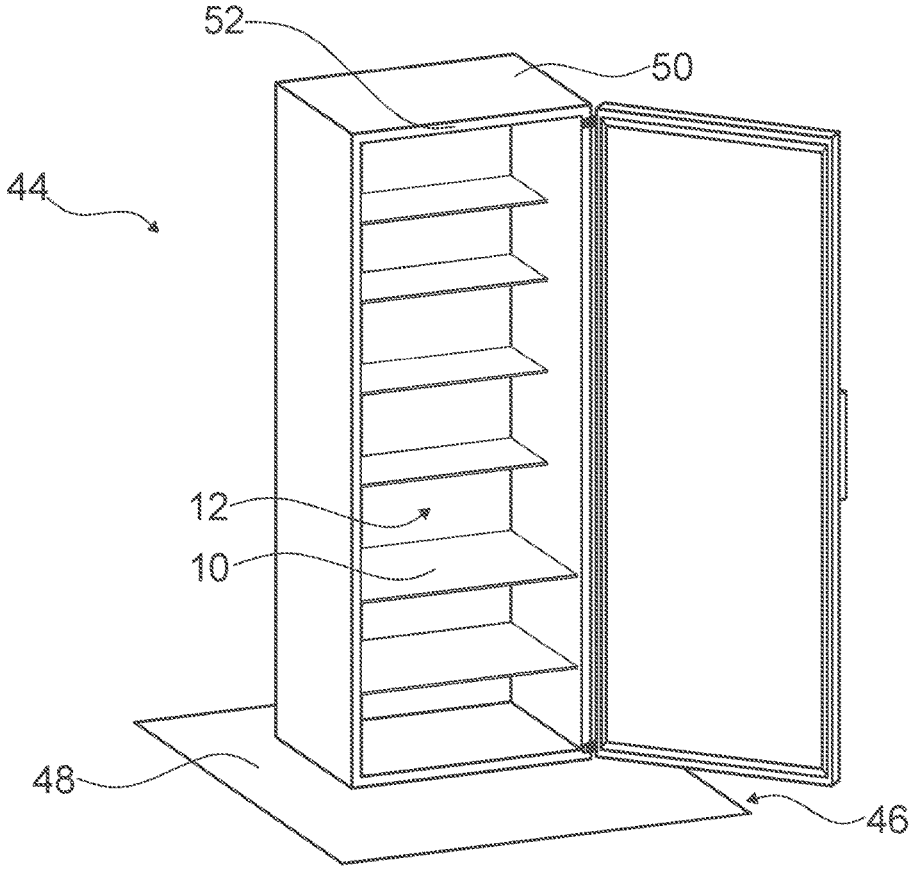
FIG. 1 a home appliance comprising a home appliance device, in a schematic perspective view, FIG. 2 a portion of the home appliance device, comprising a receptacle, in an exploded view, FIG. 3 a portion of the home appliance device, comprising the receptacle, in a perspective view, and FIG. 4 a portion of the home appliance device, comprising an insert, in an exploded view.

FIG. 1 shows a home appliance 44 comprising a home appliance device, in a schematic perspective view. In the present case the home appliance 44 is embodied as a refrigerator. The home appliance 44 could further be embodied as any other kind of home appliance deemed advantageous by someone skilled in the art, e.g. a climate cabinet, an ice-box, a freezer, a wine-cooler and/or a refrigerator-freezer combination.

In FIG. 1 the home appliance device is shown in an installed state. The home appliance device is installed on a base 46. The base 46 defines a horizontal plane 48. The home appliance device comprises a housing 50. The housing 50 is installed upright on the base 46. The housing 50 comprises an inner liner 52. The inner liner 52 defines a storage space 12. A vertical direction 24 is at least substantially perpendicular to the horizontal plane 48. A horizontal direction 26 is at least substantially parallel to the horizontal plane 48.

The home appliance device comprises at least one insert 10. In the present case the home appliance device comprises six inserts 10. For the sake of clarity, in the following only one insert 10 is given a reference numeral and is described in detail. The following description may be transferred to further inserts 10 accordingly. It is conceivable that the home appliance device may comprise a deviating number of inserts 10 as deemed advantageous by someone skilled in the art. In the present case the insert 10 is embodied as a dividing plate. The home appliance device may preferably comprise a combination of different embodiments of inserts 10, for example at least one insert 10 embodied as a dividing plate and at least one further insert 10 embodied as a bottle holder. The insert 10 is insertable into the storage space 12. The insert 10 divides the storage space 12 into storage areas.

The home appliance device comprises a receptacle 16. In the present case the home appliance device comprises two receptacles 16. The two receptacles 16 are arranged opposite to each other. The two receptacles 16 are arranged mirror-inverted to each other. For the sake of clarity, in the following only one receptacle 16 is given a reference numeral and is described in detail. The following description may be transferred to further receptacle 16 accordingly.

Figure 2:
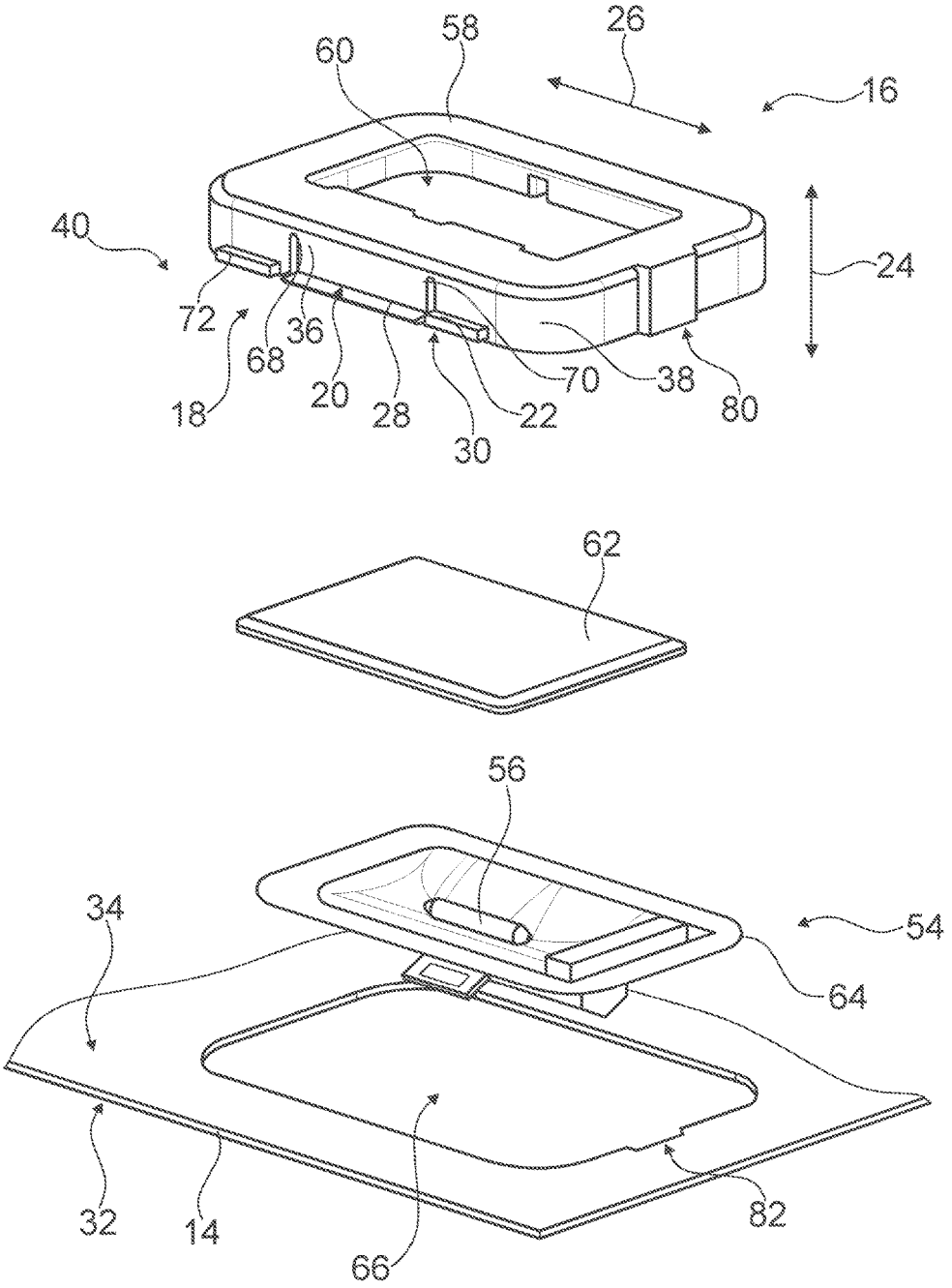
Figure 3:
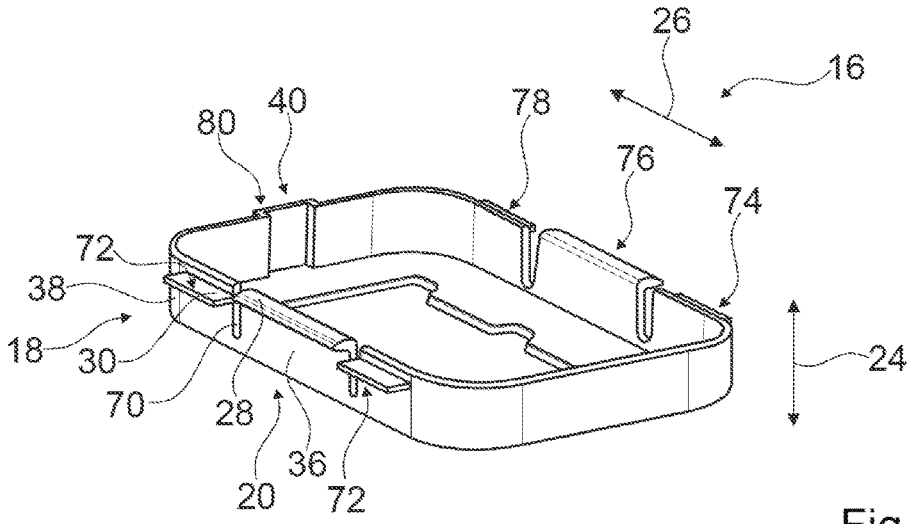

FIGS. 2-3 show different views of a portion of the home appliance device. The insert 10 comprises a lighting unit 54. The lighting unit 54 is configured for lighting at least partly the storage space 12, in particular a storage area below the insert 12. The lighting unit 54 is at least partly accommodated inside the receptacle 16. In an installation position of the insert 10, the lighting unit 54 shines in a direction of the base 46 onto which the home appliance device is installed. The lighting unit 54 comprises at least one light source 56. In the present case the light source 56 is an LED. Alternatively or additionally the light source 56 may be any light source deemed advantageous by someone skilled in the art, e.g. an OLED. In an installation position, the lighting unit 54 is accommodated inside the receptacle 16. The receptacle comprises an accommodating housing 58. The accommodating housing 58 is configured for accommodating the lighting unit 54. In an installed state the lighting unit 54 is accommodated inside the accommodating housing 58. The accommodating housing 58 comprises an opening 60. The receptacle 16 comprises a safety cover 62. The safety cover 62 is attachable to the accommodating housing 58. The safety cover 62 covers the opening 60 of the accommodating housing 58. Alternatively or additionally, the safety cover 62 can be implemented integrally with the accommodating housing 58, wherein in particular the opening 60 can be dispensed with.

Further, the receptacle 16 comprises a terminal unit 64. The lighting unit 54 is mounted to the terminal unit 64. The terminal unit 64 may at least partly be made of a refractive material. By means of the terminal unit 64 the lighting unit 54 is electrically connected to a power unit of the home appliance device. The power unit supplies the power for operating the lighting unit 54. Furthermore the lighting unit 54 may be connected to a control unit of the home appliance device, which is configured to control and/or monitor a state of the lighting unit 54.

The insert 10 comprises a base element 14. The base element 14 may preferably be made of a metal sheet. The base element 14 comprises an accommodating recess 66. In the present case the base element 14 comprises two accommodating recesses 66, one for each receptacle 16. For the sake of clarity, in the following only one accommodating recess 66 is given a reference numeral and is described in detail. The following description may be transferred to further accommodating recesses 66 accordingly. The accommodating recess 66 is cut out and/or stamped out of the base element 14. In an installed state the receptacle 16 is accommodated at least partly inside the accommodating recess 66.

The home appliance device comprises a fixing unit 18. The fixing unit 18 is configured for fixing the receptacle 16 and the base element 12 to each other. In the present case the home appliance device comprises two fixing units 18, in particular one fixing unit 16 for each receptacle 16. For the sake of clarity, in the following only one fixing unit 18 is given a reference numeral and is described in detail. The following description may be transferred to further fixing units 18 accordingly.

The fixing unit 18 fixes the receptacle 16 and the base element 14 to each other at least in a form-fit manner. It is also conceivable that the fixing unit 18 fixes the receptacle 16 and the base element 14 to each other in a force-fit manner. Additionally or alternatively, the fixing unit 18 may fix the receptacle 16 and the base element 12 by substance-to-substance bond, e.g. by a welding process, an adhesive bonding, an injection-molding process and/or by another process that is deemed expedient by a person having ordinary skill in the art.

The fixing unit 18 has a first fixing element 20. The first fixing element 20 is embodied as a deformable fixing element 20. In the present case the first fixing element 20 is repeatedly reversibly deformable. The first fixing element 20 is at least partly deformable in a direction that is at least substantially perpendicular to a main extension direction of the receptacle 16. The first fixing element 20 is at least partly made of a deformable material. The material of which the first fixing element 20 is at least partly made has an elastic modulus of at most 10 GPa. The material of which the first fixing element 20 is at least partly made is a plastic material, in particular a thermoplastic material. Alternatively or additionally the material may be a duroplastic material and/or an elastomer.

The fixing unit is at least partly implemented integrally with the receptacle 16. The accommodating housing 58 of the receptacle 16 comprises a first wall section 36. The first wall section 36 extends around the receptacle 16 in a circumferential direction. The first wall section 36 extends over at most 20% of a circumference of the receptacle 16. The first wall section 36 at least partly embodies the first fixing element 20. The first fixing element 20 comprises a hook 28. The hook 28 is a latching hook. Further the first fixing element 20 comprises a deformable latching arm 68. The latching arm 68 is connected to the hook 28. The hook 28 comprises a limiting surface which contacts the base element 14 in an installed state of the receptacle 16.

The fixing unit 18 comprises a second fixing element 22. The first fixing element 20 has a greater deformability than the second fixing element 22. The accommodating housing 58 of the receptacle 16 comprises a second wall section 38. The second wall section 38 is adjacent to the first wall section 36. The second wall section 38 at least partly embodies the second fixing element 22. The second wall section 38 extends around the receptacle 16 in a circumferential direction. The second wall section 38 extends over at least 30% of a circumference of the receptacle 16. For the purpose of improving deformability, the first wall section 36 and the second wall section 38 are embodied at least partly separate from one another. The accommodating housing 58 comprises a notch 70. The notch 70 separates the first wall section 36 and the second wall section 68 from one another. The notch 70 has a main extension direction which is a least substantially perpendicular to a main extension direction of the receptacle 16. The second fixing element 22 comprises a stopper 30. The stopper 30 comprises a further limiting surface which is in contact with the base element 14 in an installed position. By means of the limiting surface and the further limiting surface the base element 14 is clamped from a first side 32 and a second side 34.

The first fixing element 20 and the second fixing element 22 are arranged offset in the vertical direction 24 with respect to each other. The first fixing element 20 and the second fixing element 22 are arranged offset in the horizontal direction 26 with respect to each other. The first fixing element 20 and the second fixing element 22 together at least partly encompass the base element 14 in a mounted state. Alternatively or additionally, the first fixing element 20 and the second fixing element 22 together could at least partly encompass the receptacle 16. In a mounted state, the first fixing element 20 is arranged on the first side 32 of the base element 14. In the mounted state, the second fixing element 22 is arranged on the second side 34 of the base element 14.

The fixing unit 18 comprises a third fixing element 72. The first fixing element 20 and the third fixing element 72 are arranged offset in the vertical direction 24 and in the horizontal direction 26 with respect to each other. The second fixing element 22 and the third fixing element 72 are arranged offset only in a horizontal direction 26 with respect to each other. In particular the second fixing element 22 and the third fixing element 72 are implemented at least substantially equivalently to one another, in particular except for production and/or manufacturing tolerances. The description regarding the second fixing element 22 can be applied to the third fixing element 72 as well.

In addition the fixing unit 18 comprises a further first fixing element 74, a further second fixing element 76 and/or a further third fixing element 78. The further first fixing element 74, the further second fixing element 76 and/or the further third fixing element 78 are implemented at least substantially equivalently to the respective first fixing element 20, second fixing element 22 and/or third fixing element 72. The further first fixing element 74, the further second fixing element 76 and/or the further third fixing element 78 are provided at different positions, in particular opposite and preferably mirror-inverted to the respective first fixing element 20, second fixing element 22 and/or third fixing element 72. In particular, the description regarding the first fixing element 20, second fixing element 22 and/or third fixing element 72 is also applicable to the respective further first fixing element 74, the respective further second fixing element 76 and the respective further third fixing element 78.

The insert comprises a poka-yoke unit 40. The poka yoke-unit 40 defines an orientation of the receptacle 16 with respect to the base element 14. The poka-yoke unit 40 comprises a first poka-yoke element 80 and a corresponding second poka-yoke element 82. The first poka-yoke element 80 and the corresponding second poka-yoke element 82 cooperate with each other when the receptacle 16 is fixed to the base element 14 in the defined orientation. The poka-yoke unit 40 is at least partly implemented integrally with the receptacle 16. The first poka-yoke element 80 is implemented integrally with the receptacle 16. The first poka-yoke element 80 is embodied as a console of the accommodating housing 58 of the receptacle 16, preferably the second wall section 38. The poka-yoke unit 40 is at least partly implemented integrally the base element 14. The second poka-yoke element 82 is implemented integrally with the base element 14. The second poka-yoke element 82 is embodied as a recess of the base element 16, in particular as part of the accommodating recess 66.

Figure 4:
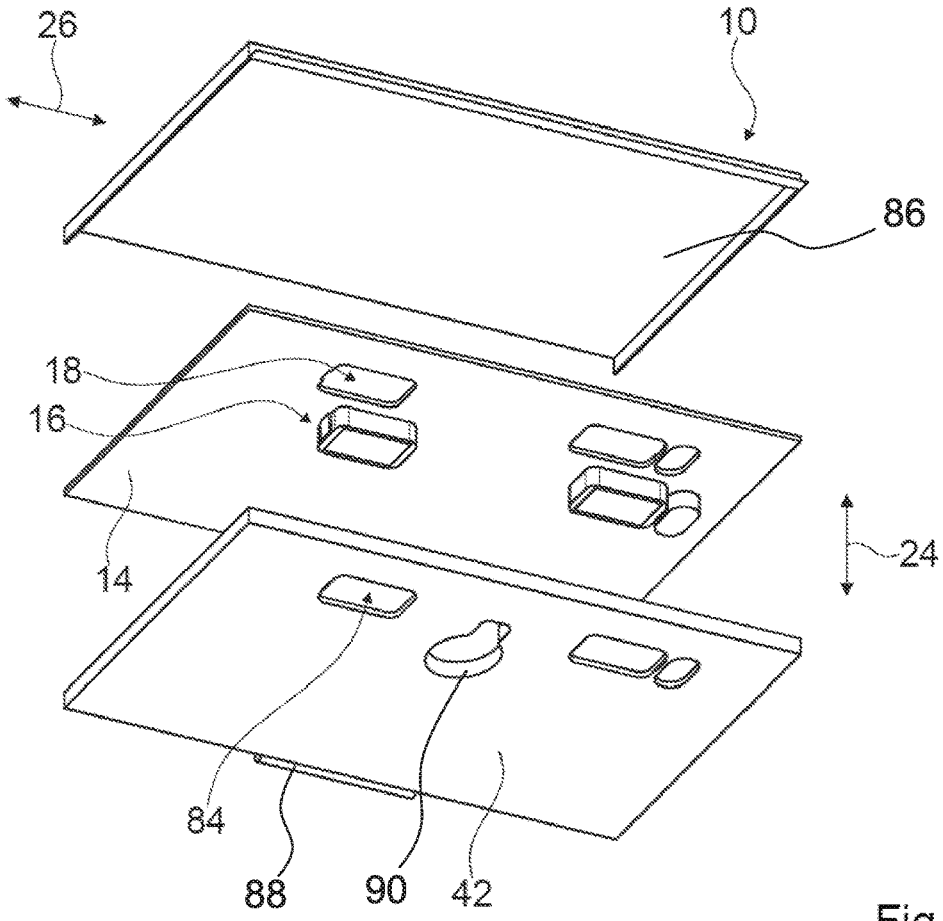

FIG. 4 shows a plate element 86, the receptacle 16, the base element 14 and a cover element 42 in an exploded view. The home appliance device comprises the cover element 42 and the plate element 86. In an installed state the cover element 42 and the plate element 86 cover the base element 14. The cover element 42 comprises a receptacle recess 84. In the present case the cover element 42 comprises two receptacle recesses 84. For the sake of clarity, in the following only one receptacle recess 84 is given a reference numeral and is described in detail. The following description may be transferred to further receptacle recesses 84 accordingly. The receptacle recess 84 is configured for at least partly accommodating the receptacle 16 in the cover element 42. The cover element 42 is arranged at least partly at least substantially flush with the receptacle 16. A thickness of the cover element 42 is at least substantially equivalent to a thickness of the receptacle 16. Between the cover element 42 and the base element 14 is an insulation material (not shown). The cover element 42 comprises an air inlet vent 88 and an air outlet vent 90.

The following is a summary list of reference numerals and the corresponding structure used in the above description of the invention:

10 Insert
12 Storage space
14 Base element
16 Receptacle
18 Fixing unit

20 First fixing element
22 Second fixing element
24 Vertical direction
26 Horizontal direction
28 Hook
30 Stopper element
32 First side
34 Second side
36 First wall section
38 Second wall section
40 Poka-yoke unit
42 Cover element
44 Home appliance
46 Base
48 Horizontal plane
50 Housing
52 Inner liner
54 Lighting unit
56 Light source
58 Accommodating housing
60 Opening
62 Safety cover
64 Terminal unit
66 Accommodating recess
68 Latching arm
70 Notch
72 Third fixing element
74 Further first fixing element
76 Further second fixing element
78 Further third fixing element
80 First poka-yoke element
82 Second poka-yoke element
84 Receptacle recess
86 Plate element
88 Air inlet vent
90 Air outlet vent

The invention claimed is:

1. A home appliance device comprising:

a storage space, delimited by an inner liner of the home appliance device;

an insert which is insertable into the storage space, the insert comprising a base element, a receptacle affixed to the base element and a fixing unit fixing the receptacle to the base element, the fixing unit having at least one first fixing element and at least one second fixing element which are arranged offset in a vertical direction and in a horizontal direction with respect to each other and which together at least partly encompass the base element and/or the receptacle in a mounted state of the receptacle; and the first fixing element being arranged on a first side of the base element and the second fixing element being arranged on a second side of the base element.

2. The home appliance device according to claim 1, the fixing unit fixing the receptacle to the base element at least in a form-fit manner.

3. The home appliance device according to claim 1, the first fixing element being deformable.

4. The home appliance device according to claim 1, the first fixing element comprising a hook.

5. The home appliance device according to claim 1, the second fixing element comprising a stopper element.

6. The home appliance device according to claim 1, the fixing unit being at least partly implemented integrally with the receptacle.

7. The home appliance device according to claim 1, the receptacle comprising a first wall section, which at least partly embodies the first fixing element.

8. The home appliance device according to claim 7, the receptacle comprising a second wall section adjacent to the first wall section, which at least partly embodies the second fixing element.

9. The home appliance device according to claim 7, the first wall section and the second wall section being embodied at least partly separate from one another.

10. The home appliance device according to claim 1, the insert comprising a poka-yoke unit which defines an orientation of the receptacle with respect to the base element.

11. The home appliance device according to claim 10, the poka-yoke unit being at least partly implemented integrally with the receptacle and/or the base element.

12. The home appliance device according to claim 1, the insert comprising a cover element which covers the base element and which is arranged at least partly at least substantially flush with the receptacle.

13. The home appliance device according to claim 1, the insert comprising a lighting unit, which is at least partly accommodated inside the receptacle.

14. A home appliance comprising a home appliance device according to claim 1.

15. The home appliance according to claim 14 configured as a home chiller appliance.

16. A home appliance device comprising:

a storage space, delimited by an inner liner of the home appliance device;

an insert which is insertable into the storage space, the insert comprising a base element, a receptacle affixed to the base element and a fixing unit fixing the receptacle to the base element, the fixing unit having at least one first fixing element and at least one second fixing element which are arranged offset in a vertical direction and in a horizontal direction with respect to each other and which together at least partly encompass the base element and/or the receptacle in a mounted state of the receptacle; and the insert having a cover element which covers the base element and which is arranged at least partly at least substantially flush with the receptacle.

17. The home appliance device according to claim 16, the first fixing element, in a mounted state, being arranged on a first side of the base element and the second fixing element, in a mounted state, being arranged on a second side of the base element.

* * * * *